US005929824A

United States Patent [19]

Johansson et al.

[11] Patent Number: 5,929,824

[45] Date of Patent: Jul. 27, 1999

[54] ANTENNA ELEMENT, CONICALLY HELICAL, FOR POLARIZATION PURITY WITHIN A BROAD FREQUENCY RANGE

[75] Inventors: Jan-Olof Johansson, Göteborg; Pär Bengtsson, Alingsås, both of Sweden

[73] Assignee: Saab Ericsson Space AB, Göteborg, Sweden

[21] Appl. No.: 08/981,113

[22] PCT Filed: Jun. 12, 1996

[86] PCT No.: PCT/SE96/00767

§ 371 Date: Dec. 17, 1997

§ 102(e) Date: Dec. 17, 1997

[87] PCT Pub. No.: WO97/01196

PCT Pub. Date: Jan. 9, 1997

[30] Foreign Application Priority Data

Jun. 20, 1995 [SE] Sweden ..... 9502233

[51] Int. Cl.[6] ..... H01Q 1/36

[52] U.S. Cl. ..... 343/895; 343/853

[58] Field of Search ..... 343/785, 895, 343/778, 829, 846, 850, 853; H01Q 1/36

[56] References Cited

U.S. PATENT DOCUMENTS

| | | | |
|---|---|---|---|
| 3,188,643 | 6/1965 | Dyson et al. . | |
| 3,633,210 | 1/1972 | Westerman | 343/895 |
| 4,008,479 | 2/1977 | Smith | 343/895 |
| 4,766,444 | 8/1988 | Conroy | 343/895 |
| 5,346,300 | 9/1994 | Yamamoto et al. | 343/895 |
| 5,349,365 | 9/1994 | Ow et al. . | |
| 5,479,182 | 12/1995 | Sydor | 343/895 |
| 5,485,170 | 1/1996 | McCarrick | 343/895 |

FOREIGN PATENT DOCUMENTS

| | | |
|---|---|---|
| 0 465 658 A1 | 1/1992 | European Pat. Off. . |
| 0465658 | 1/1992 | European Pat. Off. . |

*Primary Examiner*—Don Wong
*Assistant Examiner*—Tho Phan
*Attorney, Agent, or Firm*—Pollock, Vande Sande & Amernick

[57] ABSTRACT

An antenna element including a ground plane. A support supports a conical structure. The support is made of a dielectric material. A bottom portion of the support is attached to the ground plane. Four conical radiation means are symmetrically arranged around the support. Each radiation elements includes a helical wire having a top end and a bottom end. The bottom ends of the radiation elements are attached to the ground plane. Four coaxial cables including conductors are provided. One coaxial cable is connected to the top end of each radiation element for providing each radiation element with a microwave signal for emitting two orthogonally polarized radiations. A distribution network divides an incoming signal into four subsignals offset in phase in relation to each other. One of the subsignals is provided to each of the four radiation elements. Adaption elements adapts an output impedance of the distribution network to an input impedance of the radiation elements. The adaption elements include four channels and the conductor of one of the coaxial cables extending therethrough. Each channel extends through a metal block.

15 Claims, 2 Drawing Sheets

ANTENNA ELEMENT, CONICALLY HELICAL, FOR POLARIZATION PURITY WITHIN A BROAD FREQUENCY RANGE

FIELD OF THE INVENTION

The present invention relates to antenna elements, typically for use on satellites.

BACKGROUND OF THE INVENTION

Antenna elements such as those of the present invention are used particularly in group antennas for satellites. Such antennas should have a good polarization purity. That is, such antennas should obtain a low amount of radiation of non-desired polarization and a high amount of radiation having desired polarization. At the same time there is a need for broadband such antennas should obtain the antenna will be able to emit and receive microwave signals within a relatively wide frequency range. If the frequency range is limited to one or more narrow bands, the polarization purity itself can be improved but only at the sacrifice of the broadband characteristics.

SUMMARY OF THE INVENTION

The purpose of the present invention is to provide an antenna element of the kind discussed above, which permits both a high polarization purity and broad band properties. The present invention relates to an antenna element comprising a ground plane and a conical support of a dielectric material. A bottom portion of the conical support is attached to the ground plane and supports first to fourth radiation means having the shape of helical wires arranged symmetrically around and carried by the support. The radiation means are, at their exterior, lower ends attached to the ground plane. For transmission, each radiation means is provided, at their upper, interior parts, through an individual coaxial cable with an individual microwave signal, so that two orthogonal polarizations that preferably are circular are generated by the emitted radiation.

According to the present invention such an antenna element is primarily characterized in that. for transmission, a distribution network is arranged to divide the incoming signal into four subsignals that are offset in phase in relation to each other. Each signal is provided to one of the first to fourth radiation means mentioned above. Adaption means are arranged to adapt the output impedance of the distribution network to the input impedance of the radiation means, so that it is substantially independent of the actual microwave frequency used within a relatively wide frequency range.

In an advantageous embodiment of the antenna element according to the present invention, the adaption means comprises four separate conductors that constitute capacitive loads, which, with their ends are connected to the upper ends of a corresponding radiation means.

In an alternative embodiment, the adaption means comprises a metal block constructed to include four interior channels through which the respective conductor in the coaxial cables extend substantially centrally.

BRIEF DESCRIPTION OF THE DRAWINGS

The invention will be described in the following in greater detail with reference to the accompanying schematic drawings in which.

DETAILED DESCRIPTION OF THE INVENTION

Figure 1A:
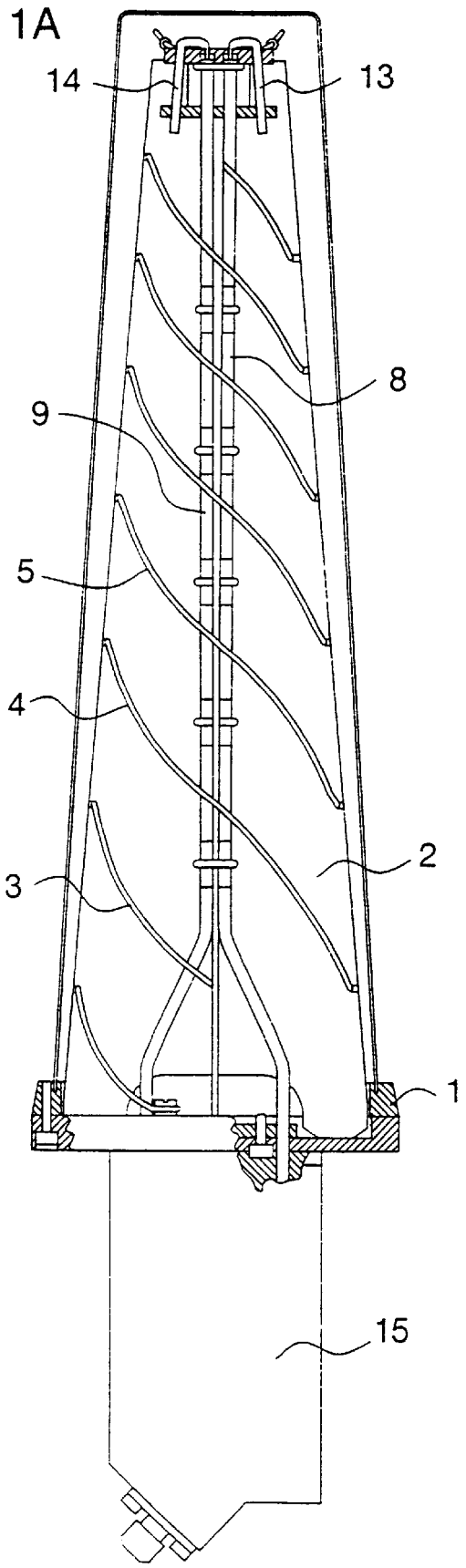
FIG. 1A shows an elevational view, which partially is a sectional view, of an antenna element according to the present invention.
Figure 1B:
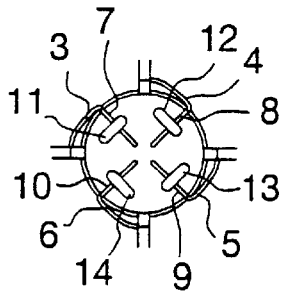
FIG. 1B shows the antenna element of FIG. 1A as seen from above.

In FIGS. 1A and 1B a ground plane having the shape of a circular metal plate has the reference numeral 1. A conical support 2 of a dielectric material is, with its bottom, portion attached to the ground plane. The support is constructed from two planes arranged orthogonally in relation to each other and carries at its geometric envelope surface first to fourth radiation means having the shape of helical wires 3 to 6 that are arranged symmetrically around the support. Four coaxial cables, two cables thereof having the reference numerals 8,9 being shown in FIG. 1A, extend up through the center of the support. The conductors in these coaxial cables, that are referenced 7–10, are, at their top portions, joined to one helical wire 3–6 each. The latter ones are, at their bottom portions, joined to the ground plane 1. The lobes of the antennas can be varied by changing the conical apex angle of the support and the angular pitch of the helical wires.

In this embodiment of the antenna element according to the present invention, adaption means having the shape of four separate conductors 11 to 14 are directly connected to, that is, by being soldered to an end of an above mentioned conductor 7–10, before the connection thereof to the respective radiation means. These separate conductors 11–14 are thus constituted of short metal wires each having a non-connected connected end free so that they constitute capacitive loads.

The antenna signal is fed through a distribution network 15, not shown in detail. The signal is divided in four signals having the same amplitude but having phases distributed at the angular values of 0°, 90°, 180°, and 270°. These signals are delivered to the four coaxial cables.

The distribution network, the adaption means and the radiation means are now so arranged that a high polarization purity is obtained within a wide frequency range. If the elevational lobe of the antenna element is maintained constant and is varied azimuthally, a minimal variation of the radiation of the desired polarization, that can be linear or elliptical, in particular circular, is obtained.

Figure 4:
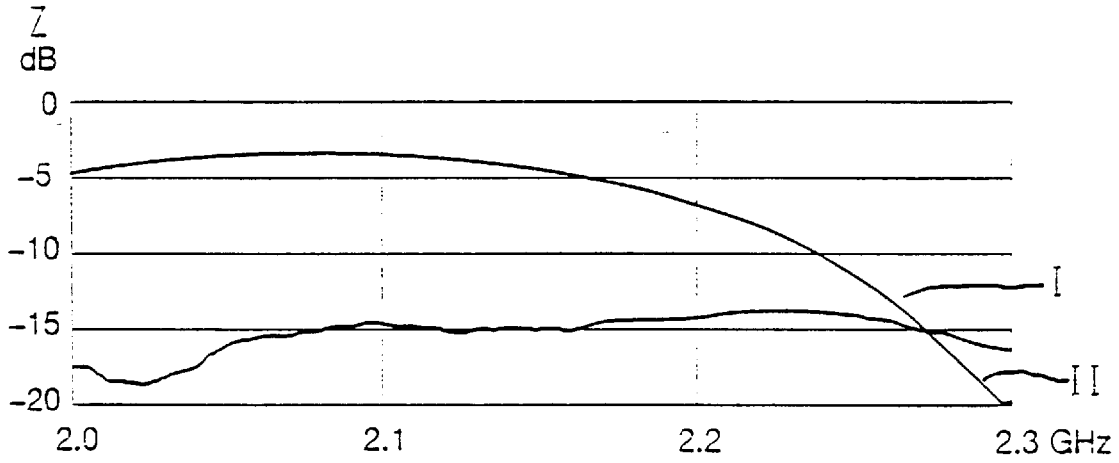
FIG. 4 shows the input impedance Z of the radiation means as a function of the frequency in GHz for an older antenna element, graph I, and an antenna element according to the invention, graph II.

It is possible to use the adaption means shown in FIGS. 1A and 1B within the frequency range of 2.0 to 2.3GHz, for example. In FIG. 4, for example a comparison is shown of the input impedance Z of the radiation means for an older design of an antenna element of the kind mentioned in the introduction, by line I, and by line II for an antenna element according to the invention. It is apparent that the impedance is relatively independent of the frequency of the antenna element according to the invention.

Figure 2A:
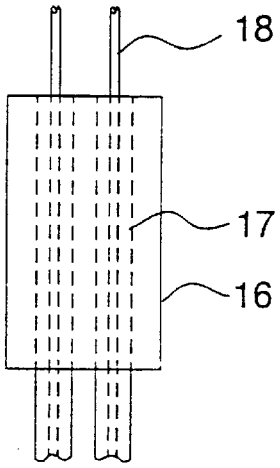
FIG. 2A shows an elevational view, which partially is a sectional view, of an adaption means.
Figure 2B:
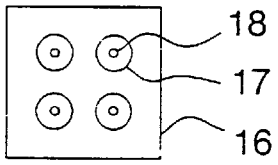
FIG. 2B shows the adaption means of FIG. 2A as seen from above.

An alternative embodiment of the adaption means having the shape of an adaption transformer is shown in FIGS. 2A and 2B. It consists of a metal block 16 having four interior channels 17, through which the respective conductor 18 of the coaxial the cables 8, 9 extend substantially centrally, having distance washers of a dielectric material. This adaption means is placed at the top of the antenna element, close to the connection to the radiation means, and is suited for use, for example within the frequency range of 1.2 to 1.6 GHz.

Figure 3A:
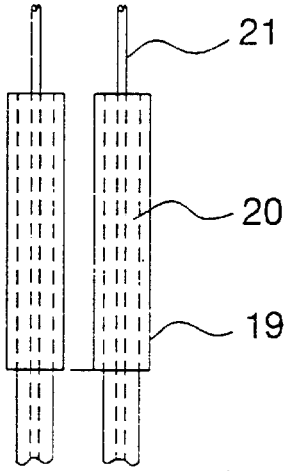
FIG. 3A shows an elevational view, which partially is a sectional view, of an alternative adaption means.
Figure 3B:
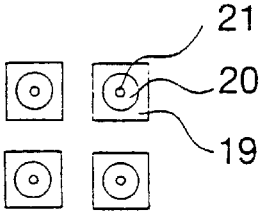
FIG. 3B shows the adaption means of FIG. 3A as seen from above.

A variant the last mentioned embodiment of the invention shown in FIGS. 3A and 3B comprises adaption means that include four metal blocks 19. Each block has an interior channel 20, through which one of the four conductors 21 in the coaxial cables 8, 9 extends substantially centrally. The four metal blocks 19, which are similar to each other, are arranged, as seen in a cross sectional view shown in FIG. 3B, in a square pattern at some distance from each other.

We claim:

1. An antenna element, comprising:

a ground plane;

a support for supporting a conical structure, the support being made of a dielectric material, a bottom portion of the support being attached to the ground plane;

four conical radiation means symmetrically arranged around the support, each radiation means comprising a helical wire having a top end and a bottom end, the bottom ends of the radiation means being attached to the ground plane;

four coaxial cables including conductors, one coaxial cable being connected to the top end of each radiation means for providing each radiation means with a microwave signal for emitting two orthogonally polarized radiations;

a distribution network for dividing an incoming signal into four subsignals offset in phase in relation to each other, one of the subsignals is provided to each of the four radiation means; and adaption means for adapting an output impedance of the distribution network to an input impedance of the radiation means, the adaption means comprising four channels and the conductor of one of the coaxial cables extending therethrough, each channel extending through a metal block.

2. The antenna element according to claim 1, wherein the adaption means is arranged in the vicinity of the top ends of the radiation means.

3. The antenna element according to claim 2, wherein the channels of the adaption means all extend through one metal block.

4. The antenna element according to claim 2, wherein each of the channels of the adaption means extends through a separate metal block.

5. The antenna element according to claim 4, further comprising:

distance washers for maintaining the conductors of the coaxial cables centrally located in the channels of the adaption means.

6. The antenna element according to claim 5, wherein the distance washers comprise dielectric material.

7. The antenna element according to claim 5, wherein the channels of the adaption means all extend through one metal block.

8. The antenna element according to claim 3, wherein each of the channels of the adaption means extends through a separate metal block.

9. The antennal element according to claim 1, wherein the microwave signal is distributed to each coaxial cable phase shifted with angles of 0°, 90°, 180°, and 270°.

10. The antenna element according to claim 9, wherein the channels of the adaption means all extend through one metal block.

11. The antenna element according to claim 9, wherein each of the channels of the adaption means extends through a separate metal block.

12. The antenna element according to claim 1, wherein the channels of the adaption means all extend through one metal block.

13. The antenna element according to claim 1, wherein each of the channels of the adaption means extends through a separate metal block.

14. The antenna element according to claim 1, wherein the channels of the adaption means are arranged in a square pattern.

15. The antenna element according to claim 1, wherein the channels are all parallel to each other.

* * * * *